US006967293B1

(12) United States Patent
Chen et al.

(10) Patent No.: US 6,967,293 B1
(45) Date of Patent: Nov. 22, 2005

(54) ROLLER CONSTRUCTION MODULE HAVING AN ERROR PREVENTION STRUCTURE

(75) Inventors: Li-Sen Chen, Gueishan Township, Taoyuan County (TW); Chien-Yu Hsu, Gueishan Township, Taoyuan County (TW); Chang-Yi Li, Gueishan Township, Taoyuan County (TW)

(73) Assignee: Speed Tech Corp., Taipei Hsien (TW)

( * ) Notice: Subject to any disclaimer, the term of this patent is extended or adjusted under 35 U.S.C. 154(b) by 0 days.

(21) Appl. No.: 10/895,038

(22) Filed: Jul. 21, 2004

(51) Int. Cl.[7] ..... H01H 19/58
(52) U.S. Cl. ..... 200/14; 200/4; 200/18; 345/157; 74/471
(58) Field of Search ..... 200/14, 4, 18, 200/11 TW, 11 G, 5 R; 345/157–158, 163–168; 74/471; 341/35

(56) References Cited

U.S. PATENT DOCUMENTS 5,290,977 A * 3/1994 Huang ..... 200/14
5,491,311 A * 2/1996 Muscat et al. ..... 200/4
6,333,473 B1 * 12/2001 Sawada et al. ..... 200/4
6,388,212 B1 * 5/2002 Ishihara et al. ..... 200/18
6,717,572 B1 * 4/2004 Chou et al. ..... 345/157

* cited by examiner

*Primary Examiner*—K. Richard Lee
(74) *Attorney, Agent, or Firm*—Troxell Law Office, PLLC

(57) ABSTRACT

The present invention is a roller construction module having an error prevention structure, comprising a base; a roller disposed in said base; two terminals at two opposite ends of the base to be electrically connected with a metal ring in the roller; a first and a second plungers on the bottom surface of the base; a post between the first and the second plungers; a third plunger on the position at the opposite side to the post on the bottom surface; and a first and a second protecting rods at two opposite ends near the third plunger. Based on the above-said structure, the switch at the left or the right side of the roller construction module can be respectively activated, and another switch, at the middle area of the mobile device, can be prevented from being activated simultaneously so that error prevention is achieved.

7 Claims, 8 Drawing Sheets

ROLLER CONSTRUCTION MODULE HAVING AN ERROR PREVENTION STRUCTURE

FIELD OF THE INVENTION

The present invention relates to a roller construction module; more particularly, to a roller construction module preventing from simultaneously activating another switch positioned at the area between the left switch and the right switch while correctly activating a switch, either at the left or the right side, so that error prevention is achieved.

DESCRIPTION OF THE RELATED ART

The technology of wireless communication has progressed a lot during the past years, so the role of a roller construction module is becoming increasingly important. Traditionally, the prior art of a roller construction module which is capable of movements in three axes (rolling forward and backward, swaying leftward and rightward and moving downward) is shown in FIG. 5 and FIG. 6. The device comprises an insulation bushing 4 outside a copper ring 41 (an encoder and a plunger), wherein the copper ring is a hollow cylinder. Two plastic shafts 51 on the base 5 are plugged into the hollow cylinder to sustain the copper ring 41. A plurality of terminals 42 is plugged into the copper ring 41 to be electrically connected with the copper ring 41 and is to be fixed on the base 5. By the connection between the terminals 42 and the circuit board 6, signals are transmitted to the circuit board through the copper ring (encoder). A plurality of raised spots is on the bottom surface of the base 5, wherein one of them (the longer at the center) is a post 52 as a supporter on the circuit board, and the other three spots 53, 54, 55 are used to activate the sheet switch 61, 62, 63 as plungers on the circuit board.

Please refer to FIG. 7, which is a view showing the status of using the roller construction module according to the prior art. When a force is applied at the position shown in the figure as pressing down by 0.43 mm, the roller construction module will swing along the arrow and the switch positioned under the bottom surface of the base will be activated. (Please refer to FIG. 8.) If the force keeps applying at the same position and the roller construction module swings down by additional 0.1 mm, the switch at the central area under the bottom surface of the base will be activated, too. Therefore, the roller construction module according to the prior art, if the user continues pressing the same position, another switch, under the bottom surface of the base, will be activated too and an error will occur.

SUMMARY OF THE INVENTION

The main purpose of the present invention is that, by the first and the second protecting rod, the switch at the left or the right side of the roller construction module is correctly activated and the switch at the middle area under the base is prevented from being activated simultaneously so that error prevention is achieved.

To achieve the above purpose, the present invention is a roller construction module comprising a base and a roller. Two opposite ends of the base comprise respectively a terminal to be electrically connected with a metal ring inside the roller. A first and a second plungers are at the two ends of a side on the bottom of the base, wherein a post is between the first and the second plunger; and a third plunger is on the corresponding position at the opposite side, wherein a first and a second protecting rods are at two opposite ends near the third plunger. Accordingly, the switch at the left or the right side of the roller construction module can be respectively activated, and another switch, at the middle area under the base, is prevented from being activated simultaneously, so that error prevention is achieved.

BRIEF DESCRIPTIONS OF THE DRAWINGS

The present invention will be better understood from the following detailed description of preferred embodiments of the invention, taken in conjunction with the accompanying drawings, in which FIG. 1 is a perspective view according to the present invention;

DESCRIPTION OF THE PREFERRED EMBODIMENT

Figure 1:
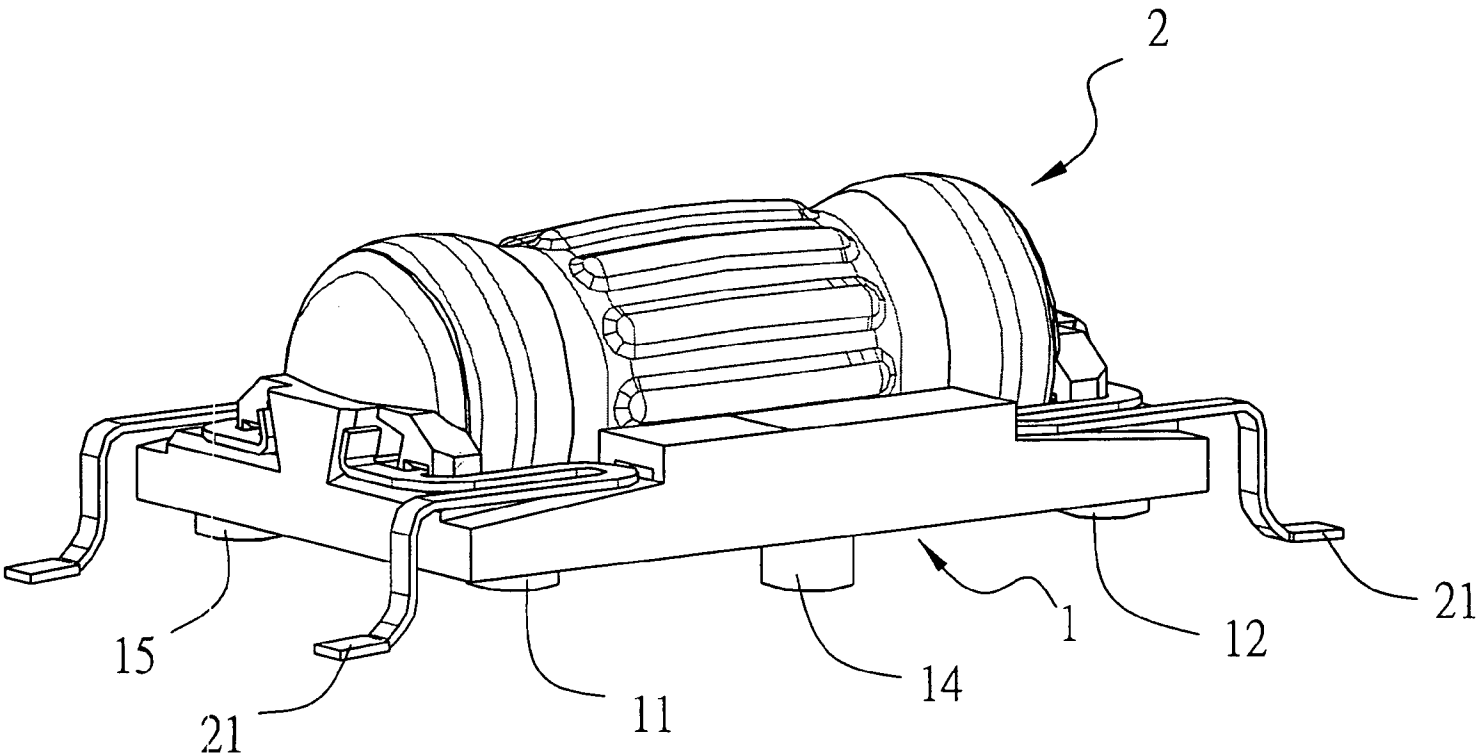
Figure 2:
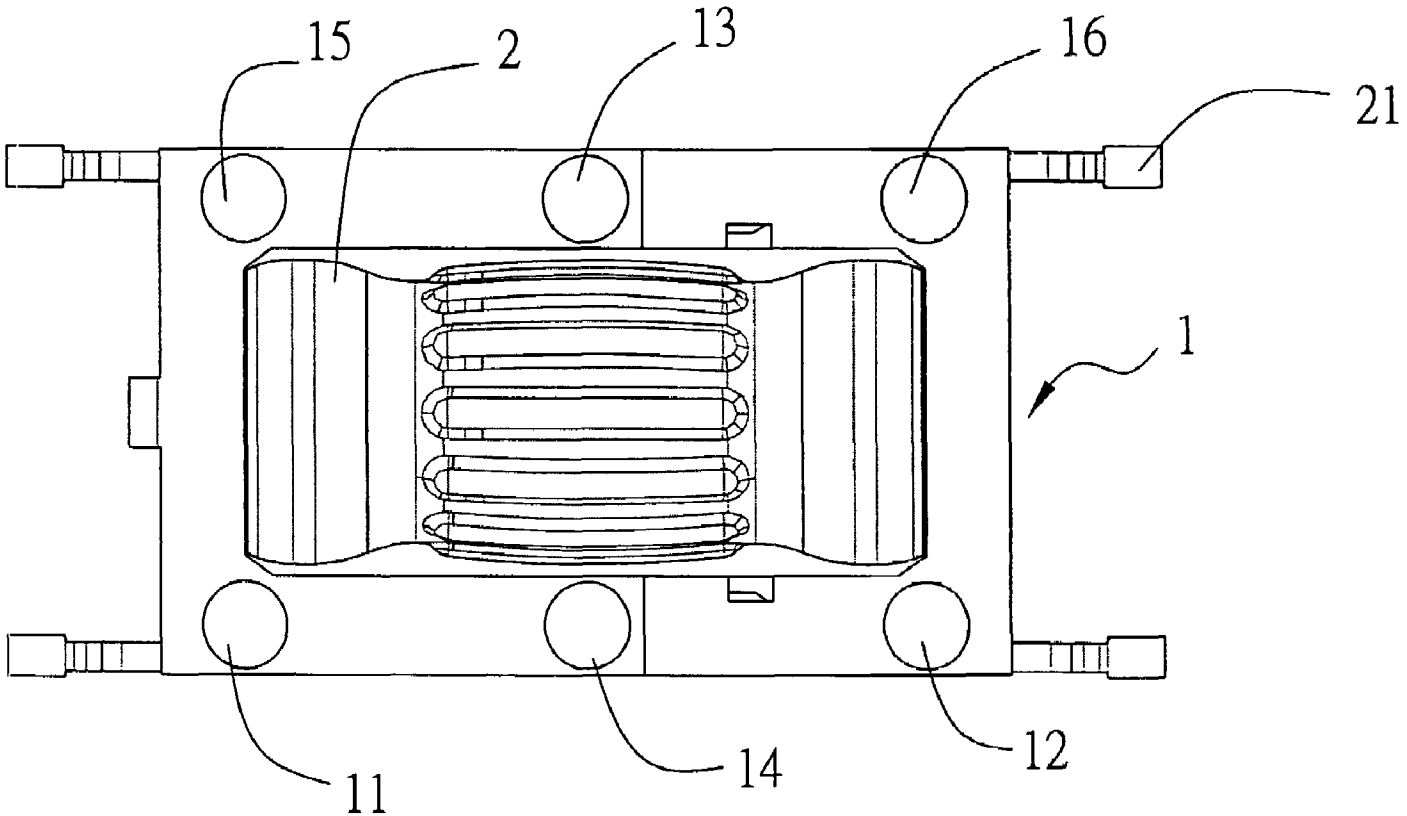
FIG. 2 is a bottom plane view according to the present invention.
Figure 3:
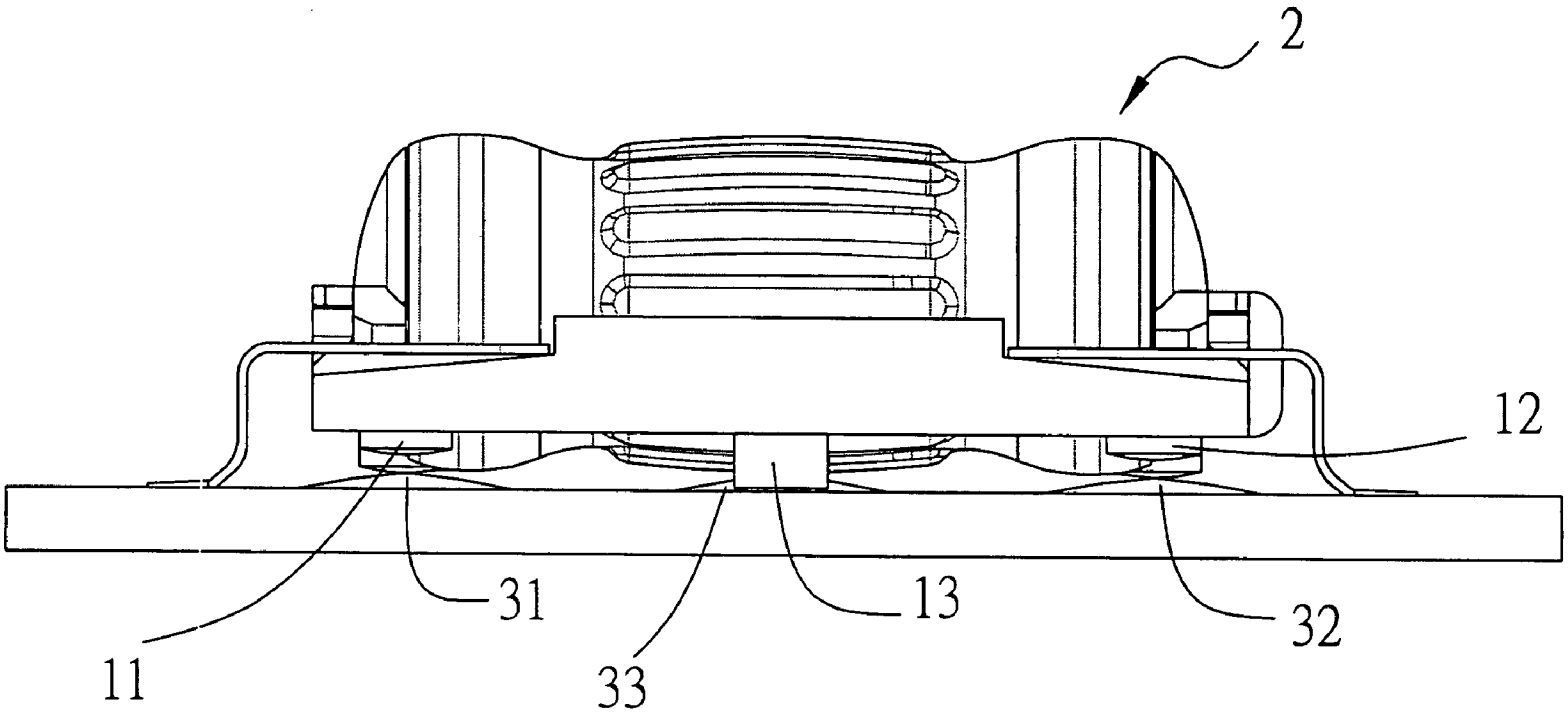
FIG. 3 and FIG. 4 are views showing the status of use according to the present invention.

The following descriptions of the preferred embodiment are provided to understand the features and the structures of the present invention.

Please refer to FIG. 1 through FIG. 4, which are views of the preferred embodiment according to the present invention. The present invention comprises an error prevention structure for a roller construction module as a communication interface between a user and an electronic system built in an electronic equipment which can be a PDA, a mobile phone, a Smart Phone, etc. (not shown in the figures). The preferred embodiment is a roller construction module capable of movements along three axes, which are rolling forward and backward, swaying leftward and rightward and moving downward. The preferred embodiment comprises a base 1; a roller 2 disposed in the base 1; two terminals 21 at two opposite ends of the base 1 to be electrically connected with a copper ring inside the roller 2; a first plunger 11 and a second plunger 12 at two opposite ends of a side on the bottom surface of the base; a post 14 between the first and the second plungers 11, 12; and a third plunger 13 on a position at the opposite side corresponding to the post 14 on the bottom surface. Therein, the terminals 21 are electrically connected with default contacts on the circuit board 3 in the electronic device to identify the movements of rolling forward or backward. The first, the second and the third plungers 11, 12, 13 are corresponding to the default sheet switches 31, 32, 33 on the circuit board 3 to control the movements of swaying leftward or rightward and moving downward. And, a first and a second protecting rods 15, 16 are at two opposite ends of the side with the third plunger 13, wherein the first protecting rod 15 can be set around the corner between the first plunger 11 and the third plunger 13, and the second protecting rod 16 can be set around the corner between the second plunger 12 and the third plunger 13 and they can be cylinders or protrusions based on actual needs. Accordingly, a novel roller construction module having an error prevention structure is constructed.

After assembling, the terminals 21 of the base 1 are connected with the default contacts of the electronic mobile device. The first, the second and the third plungers 11, 12, 13 are set corresponding to the default sheet switches 31, 32, and 33 of the device. The present invention uses the terminals 21 to detect the forward and backward rolling when the roller 2 rolls; and the movement of swaying leftward, swaying rightward or moving downward is accomplished when the first, the second or the third plunger 11, 12, 13 activates a corresponding sheet switch 31, 32, 33. Among the movements, the movement of swaying leftward or rightward is done by pressing the roller 2 at the left side or the right side. When the roller 2 is pressed down at the left side or the right side, the first or the second plunger 11, 12 is lowered down and the corresponding sheet switch 31, 32 is activated; and, when the pressing-down continues, the third plunger 13 is lowered down too. Before the third plunger 13 activates the corresponding sheet switch 33, the first or the second protecting rod 15, 16 will collide with the circuit board first to prevent the third plunger 13 from activating the sheet switch 33.

Figure 4:
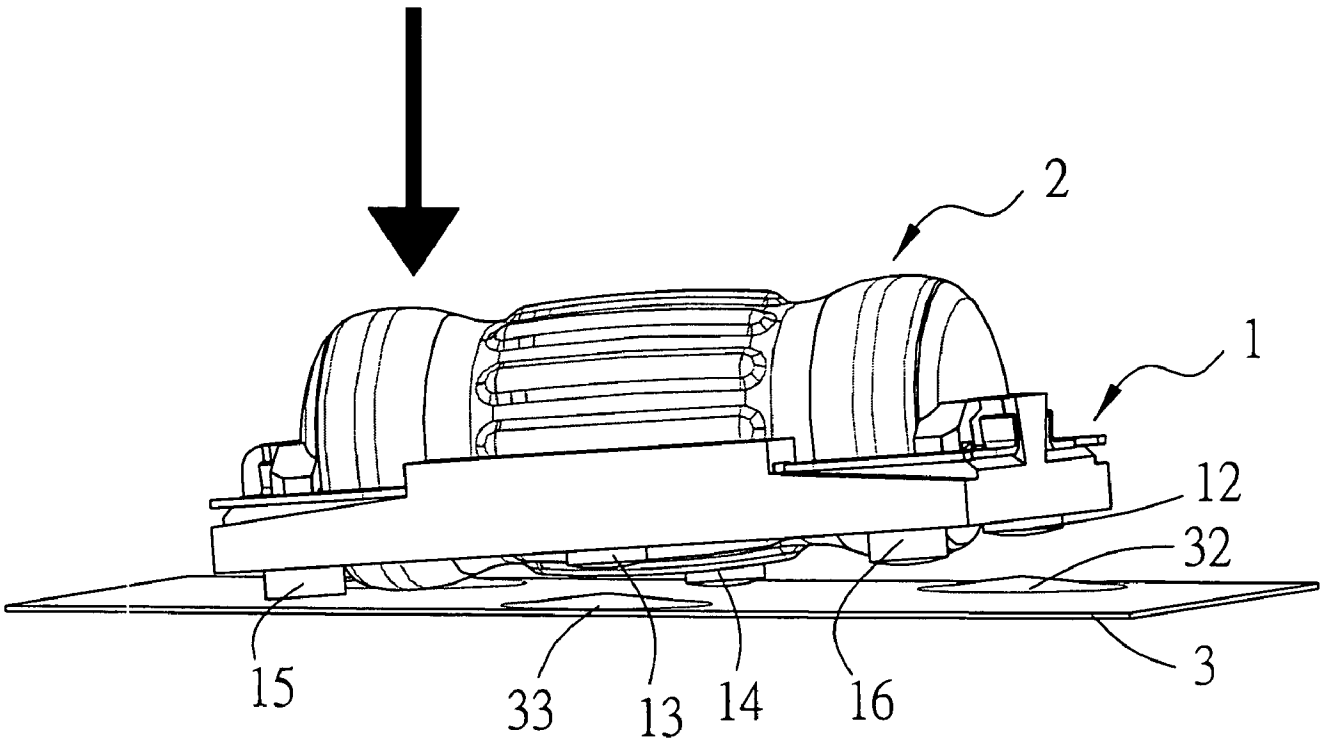
Figure 5:
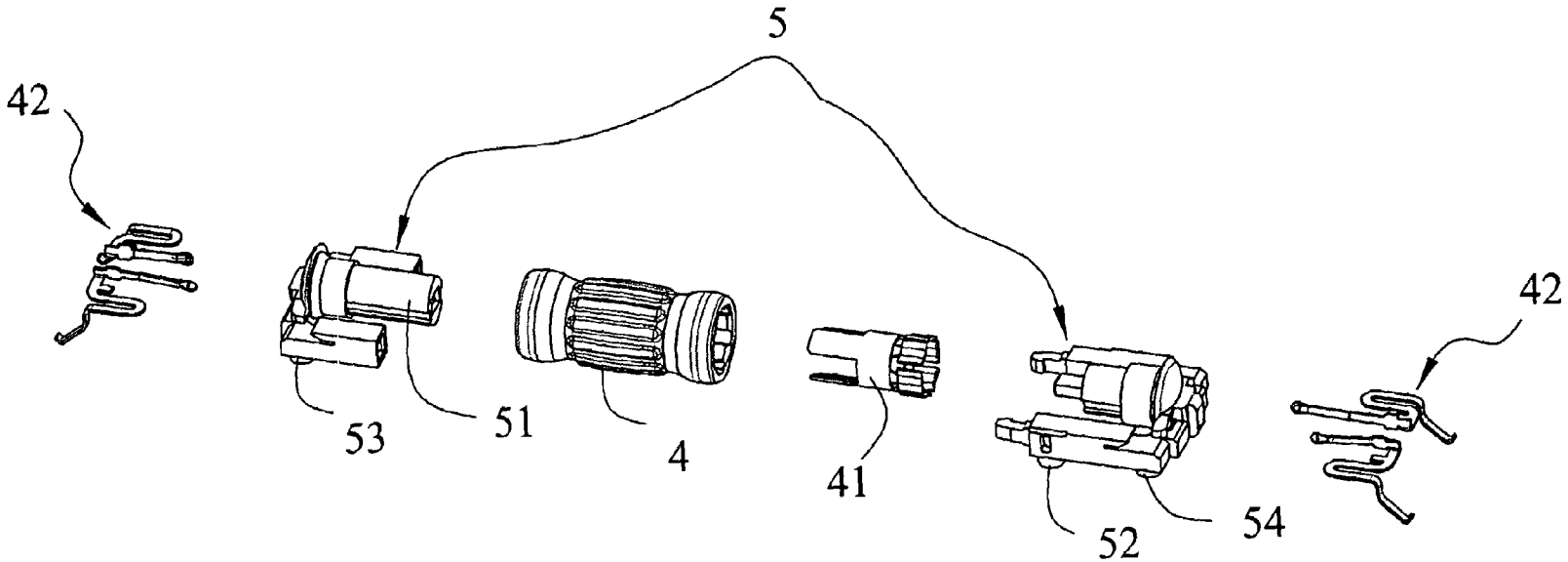
FIG. 5 is an exploded view according to the prior art.
Figure 6:
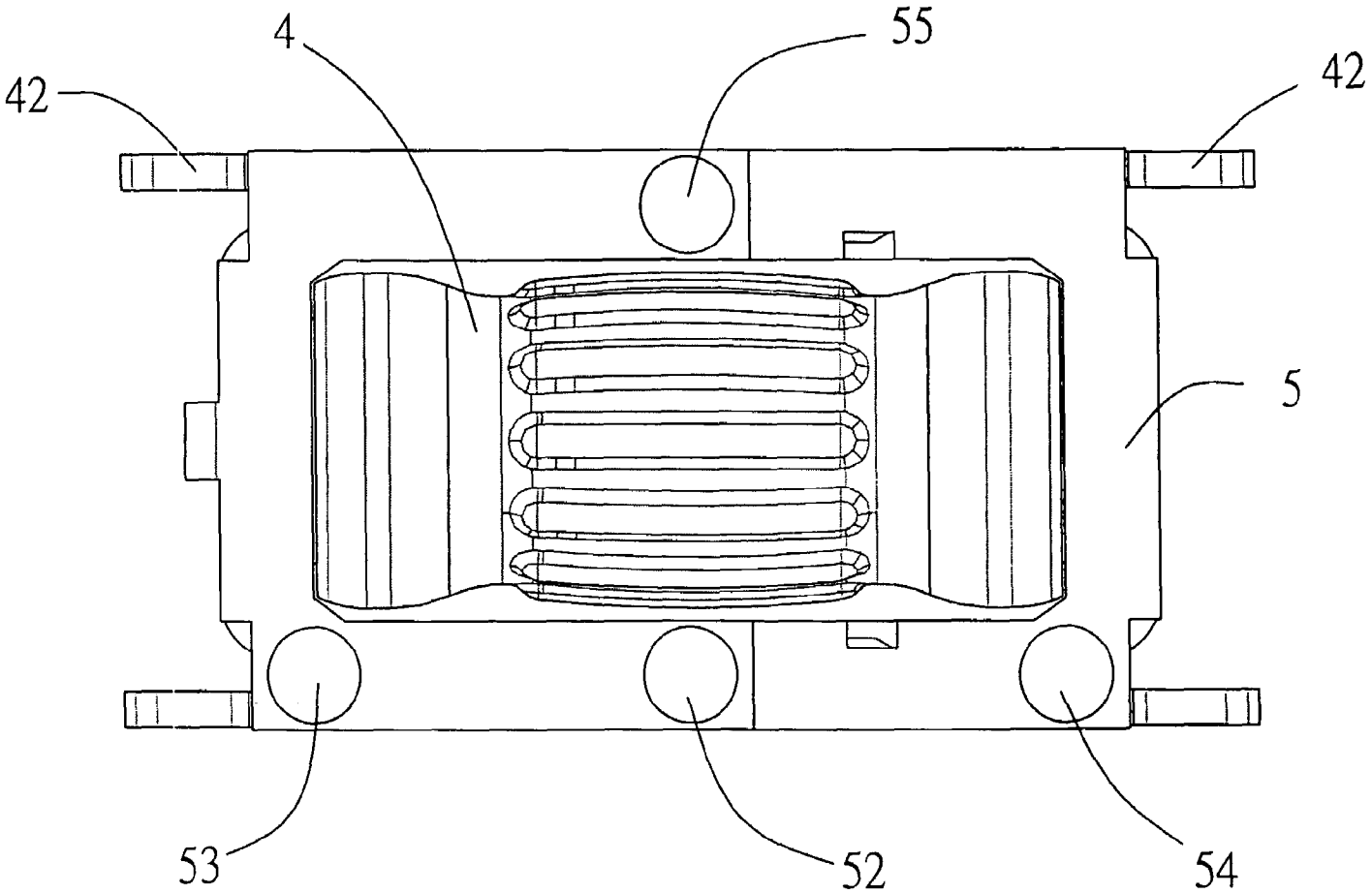
FIG. 6 is a bottom plane view according to the prior art.
Figure 7:
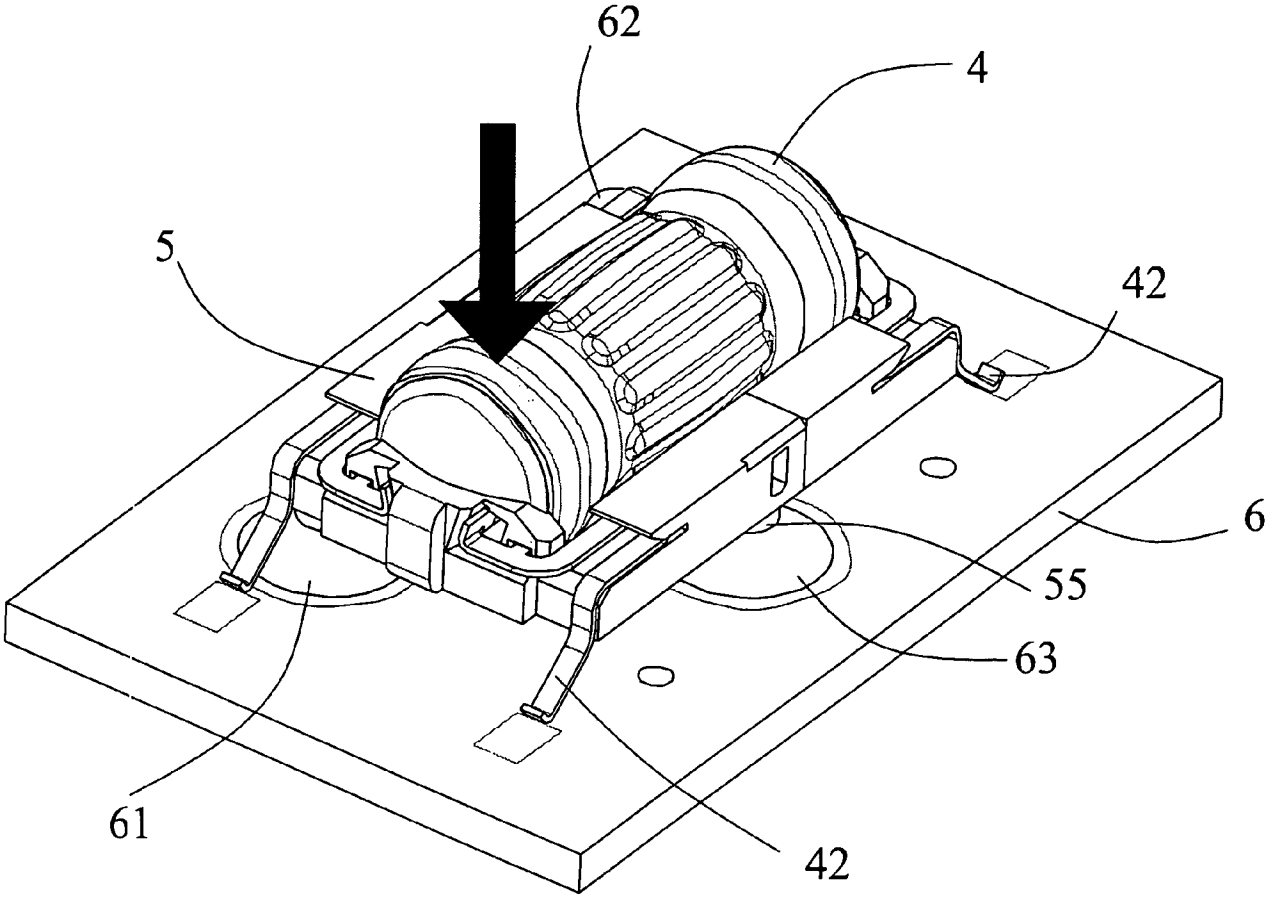
FIG. 7 is a view showing the status of use according to the prior art.
Figure 8:
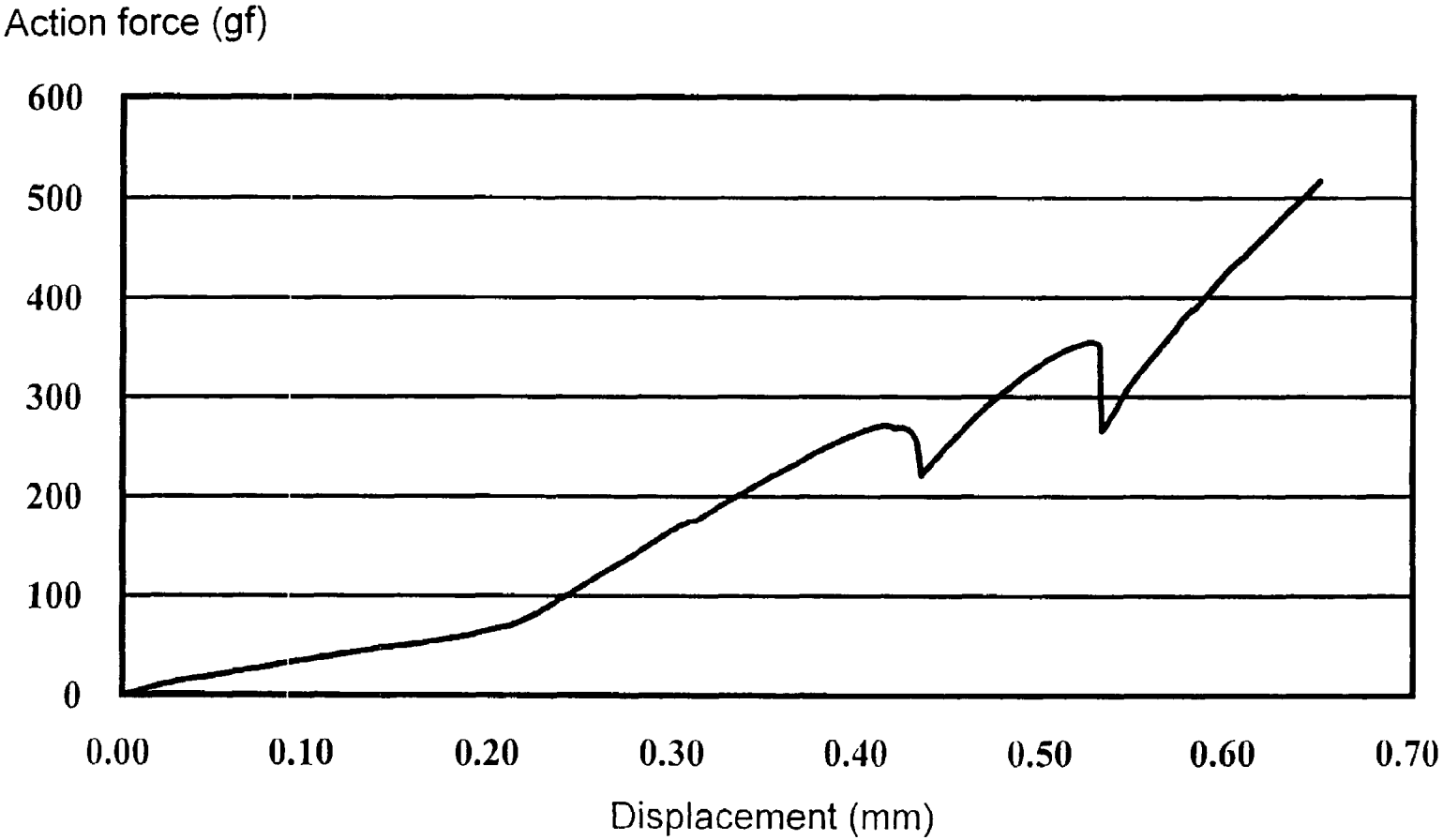
FIG. 8 is a view showing the displacement of the raised spot under a pressing-down force according to the prior art.

As shown in FIG. 4, when a force is applied at the position shown in the figure, the roller construction module will be tilted. And the displacement will stop when the first protecting rod 15 collides with the circuit board 3. At the moment, there will be enough space between the third plunger 13 and its corresponding sheet switch 33 to prevent the third plunger 13 from activating the sheet switch 33. Besides, no matter whether the roller construction module is of a contacting type or a surface-sticking type and no matter whether there is a frame for the mobile device, the switch at the left or the right side of the roller construction module can be correctly activated, and another switch, at the middle area under the base, is prevented from being activated simultaneously so that error protection is achieved.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A roller construction module having an error prevention structure, comprising:

a base having a roller;

a plurality of terminals at two opposite ends of said base electrically connected with a metal ring in said roller;

a first plunger and a second plunger, protruding respectively from two opposite ends of a surface of said base;

a post deposited between said first plunger and said second plunger; and a third plunger deposited at a position opposite to said post on said surface, characterized in that a first protecting rod is set around the corner between said first plunger and said third plunger and a second protecting rod is set around the corner between said second plunger and said third plunger.

2. The roller construction module according to claim 1, wherein said first protecting rod is a cylinder.

3. The roller construction module according to claim 1, wherein said second protecting rod is a cylinder.

4. The roller construction module according to claim 1, wherein said first protecting rod is a protrusion.

5. The roller construction module according to claim 1, wherein said second protecting rod is a protrusion.

6. The roller construction module according to claim 1, wherein said first protecting rod is on a position corresponding to said first plunger.

7. The roller construction module according to claim 1, wherein said second protecting rod is on a position corresponding to said second plunger.

* * * * *